US008905265B2

(12) United States Patent
Muderlak et al.

(10) Patent No.: US 8,905,265 B2
(45) Date of Patent: Dec. 9, 2014

(54) DISPENSER APPARATUS FOR DISPENSING LIQUID SOAP, LOTION OR OTHER LIQUID

(71) Applicant: Dispensing Dynamics International, City of Industry, CA (US)

(72) Inventors: Todd Jeffrey Muderlak, Whitefish Bay, WI (US); Roland E. C. Schwarz, Waldo, WI (US)

(73) Assignee: Dispensing Dynamics International, City of Industry, CA (US)

( * ) Notice: Subject to any disclaimer, the term of this patent is extended or adjusted under 35 U.S.C. 154(b) by 0 days.

(21) Appl. No.: 13/748,948

(22) Filed: Jan. 24, 2013

(65) Prior Publication Data

US 2014/0124531 A1 May 8, 2014

Related U.S. Application Data

(60) Provisional application No. 61/599,532, filed on Feb. 16, 2012.

(51) Int. Cl.
*A47K 5/16* (2006.01)
*A47K 5/12* (2006.01)

(52) U.S. Cl.
CPC ..... *A47K 5/12* (2013.01)
USPC ..... 222/38; 222/36; 222/52; 222/63; 222/333; 222/181.3; 222/321.8

(58) Field of Classification Search
CPC ..... A47K 5/1217; A47K 5/16
USPC ..... 222/36, 38, 221, 222, 631, 333; 22/52, 22/63, 181.1, 181.3, 321.8
See application file for complete search history.

(56) References Cited

U.S. PATENT DOCUMENTS

| | | | | | |
|---|---|---|---|---|---|
| 1,536,264 | A | * | 5/1925 | Pardee | 417/15 |
| 4,079,861 | A | * | 3/1978 | Brown | 222/135 |
| 4,722,372 | A | * | 2/1988 | Hoffman et al. | 141/98 |
| 4,967,935 | A | * | 11/1990 | Celest | 222/52 |
| 5,100,030 | A | * | 3/1992 | Roggenburg et al. | 222/181.2 |
| 5,249,718 | A | * | 10/1993 | Muderlak | 222/642 |
| 5,255,822 | A | * | 10/1993 | Mease et al. | 222/63 |
| 5,370,267 | A | * | 12/1994 | Schroeder | 222/1 |
| 5,411,173 | A | * | 5/1995 | Weinstein | 222/38 |
| 5,625,659 | A | * | 4/1997 | Sears | 377/21 |
| 6,347,724 | B1 | * | 2/2002 | Chen et al. | 222/1 |
| 6,568,561 | B2 | * | 5/2003 | Studer et al. | 222/63 |
| 6,607,103 | B2 | * | 8/2003 | Gerenraich et al. | 222/183 |
| 6,688,499 | B2 | * | 2/2004 | Zhang | 222/413 |
| 7,281,643 | B2 | * | 10/2007 | Lin | 222/214 |
| 7,527,178 | B2 | * | 5/2009 | Lewis | 222/333 |
| 7,540,397 | B2 | * | 6/2009 | Muderlak et al. | 222/400.5 |

(Continued)

*Primary Examiner* — Kevin P Shaver
*Assistant Examiner* — Michael J Melaragno
(74) *Attorney, Agent, or Firm* — Thomas R. Lampe

(57) ABSTRACT

A hybrid dispenser incorporating structural elements providing the ability to alternatively dispense soap or other liquid from a container either by an electric motor or manually including a pivoted actuator member having cam surfaces spaced from one another on opposite sides of the pivot location, a rotatable member rotated by the motor engaging one of the cam surfaces, and a manually operable member engaging the other cam surface.

7 Claims, 2 Drawing Sheets

(56) References Cited

U.S. PATENT DOCUMENTS

| | | | | |
|---|---|---|---|---|
| 7,568,598 | B2 * | 8/2009 | Ophardt et al. | 222/518 |
| 7,588,062 | B1 * | 9/2009 | Green | 141/362 |
| 7,611,030 | B2 * | 11/2009 | Reynolds et al. | 222/1 |
| 7,621,426 | B2 * | 11/2009 | Reynolds et al. | 222/325 |
| 7,980,421 | B2 * | 7/2011 | Ophardt et al. | 222/1 |
| 7,984,825 | B2 * | 7/2011 | Ophardt et al. | 222/1 |
| 8,071,933 | B2 * | 12/2011 | Ophardt et al. | 250/221 |
| 8,074,836 | B2 * | 12/2011 | Reynolds et al. | 222/1 |
| 8,245,877 | B2 * | 8/2012 | Ophardt | 222/1 |
| 8,261,941 | B2 * | 9/2012 | Woo et al. | 222/52 |
| 8,261,942 | B2 * | 9/2012 | Chen | 222/63 |
| 8,261,950 | B2 * | 9/2012 | Cittadino et al. | 222/321.7 |
| 8,342,365 | B2 * | 1/2013 | Snodgrass | 222/63 |
| 8,558,701 | B2 * | 10/2013 | Wegelin et al. | 340/573.1 |
| 8,746,510 | B2 * | 6/2014 | Cittadino et al. | 222/183 |
| 2002/0175182 | A1 * | 11/2002 | Matthews | 222/52 |
| 2005/0087552 | A1 * | 4/2005 | Ciavarella et al. | 222/181.1 |
| 2005/0171634 | A1 * | 8/2005 | York et al. | 700/231 |
| 2006/0131329 | A1 * | 6/2006 | Sayers et al. | 222/105 |
| 2009/0045221 | A1 * | 2/2009 | Ophardt et al. | 222/52 |
| 2009/0127282 | A1 * | 5/2009 | Reynolds et al. | 222/23 |
| 2009/0266842 | A1 * | 10/2009 | Snodgrass | 222/52 |
| 2011/0017778 | A1 * | 1/2011 | Kadiks et al. | 222/190 |
| 2011/0095051 | A1 * | 4/2011 | Liao et al. | 222/52 |
| 2012/0241470 | A1 * | 9/2012 | Snodgrass et al. | 222/63 |
| 2013/0001241 | A1 * | 1/2013 | Ophardt et al. | 222/1 |

* cited by examiner

DISPENSER APPARATUS FOR DISPENSING LIQUID SOAP, LOTION OR OTHER LIQUID

This application is based on and claims the benefit of U.S. Provisional Patent Application No. 61/599,532, filed Feb. 16, 2012.

TECHNICAL FIELD

This invention relates to dispenser apparatus for dispensing a liquid, the dispenser apparatus being a hybrid providing the ability to alternatively dispense soap or other liquid from a container either by an electric motor or manually.

DISCLOSURE OF INVENTION

The present invention relates to dispenser apparatus for dispensing liquid soap, lotion or other liquid.

The dispenser apparatus includes a cabinet defining an interior for holding a container containing liquid and dispensing valve structure connected to the container to dispense liquid from the container.

Valve actuator mechanism is connected to the cabinet for operating the dispensing valve structure to dispense liquid from the container when the container and dispensing valve structure are held within the interior.

The dispenser apparatus includes an electric motor and a manually operable member movably mounted relative to the cabinet. The electric motor and the manually operable member are selectively alternatively cooperable with the valve actuator mechanism to cause the valve actuator mechanism to operate the dispensing valve structure and dispense liquid from the container.

Other features, advantages and objects of the present invention will become apparent with reference to the following description and accompanying drawings.

BEST MODE FOR CARRYING OUT THE INVENTION

Figure 3:
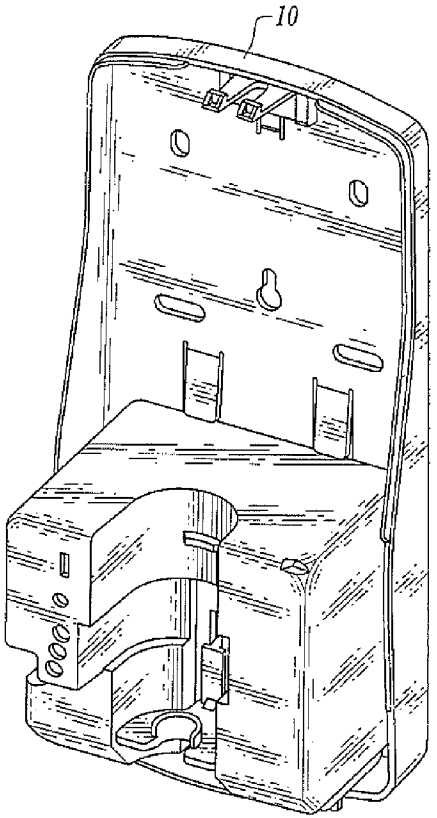
FIG. 3 is a view similar to FIG. 2, but illustrating the container and connected dispensing valve structure removed.

Referring now to the drawings, reference numeral 10 is employed to identify the cabinet of dispenser apparatus constructed in accordance with the teachings of the present invention. The dispenser apparatus is for dispensing liquid soap, however it may be employed to dispense other liquids such as lotion.

Figure 2:
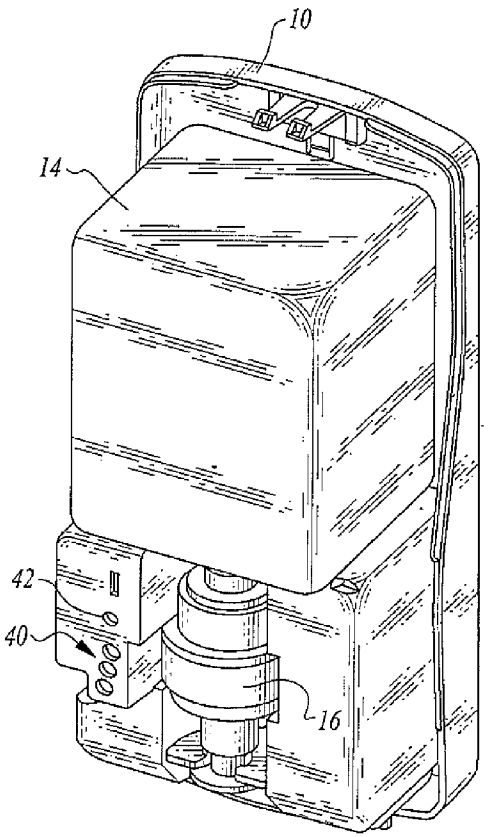
FIG. 2 is a front, perspective view illustrating the cover removed from the cabinet and a container containing liquid soap and dispensing valve structure connected thereto in operative position relative to the uncovered portion of the cabinet and related structure.
Figure 1:
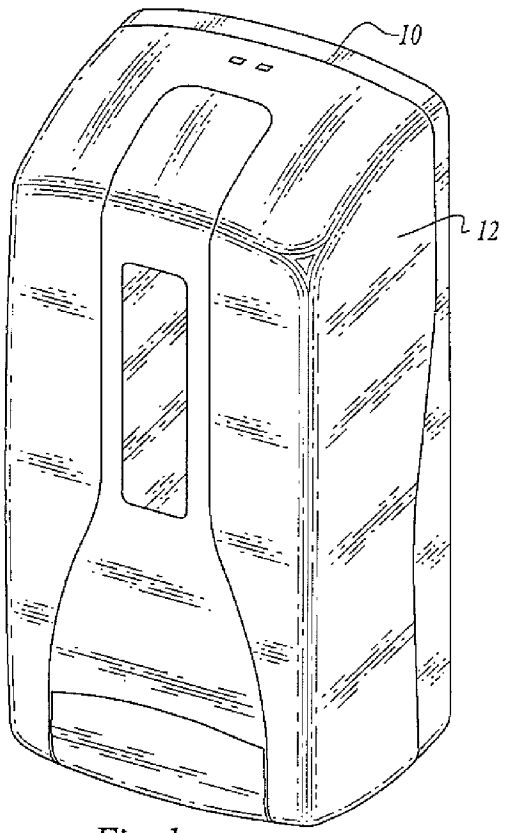
FIG. 1 is a front, perspective view of the cabinet of the dispenser apparatus.

The cabinet 10 includes a removable cover 12, the cover having been removed from the rest of the cabinet in FIGS. 2 and 3.

The cabinet defines an interior for holding a container 14 containing liquid soap and dispensing valve structure 16 of any suitable known type connected to the container to dispense liquid from the container. The dispenser apparatus suitably includes lock-out structure allowing only specific containers and dispensing valve structure combinations to be utilized. In this instance, for example, the outer configurations of the container and the dispensing valve structure match the shapes of the recesses of the apparatus containing them. Electronic lock-outs and/or other types of mechanical lock-outs may be employed in the system as well so that only specific refills may be employed in the system.

The dispenser apparatus includes valve actuator mechanism connected to the cabinet for operating the dispensing valve structure to dispense liquid from the container when the container and dispensing valve structure are installed within the container.

The valve actuator mechanism includes a rotating member 20 rotatable by an electric motor 22 when the electric motor is energized. An arrow in FIGS. 4-6 indicates the direction of rotation of rotating member 20 during consecutive stages of operation.

A manually operable member in the form of a pivotally mounted push lever 24 is accessible from a location external of the cabinet. The electric motor 22 and the pivotally mounted push lever 24 are selectively alternatively cooperable with the valve actuator mechanism to cause the valve actuator mechanism to operate the dispensing valve structure and dispense liquid from the container.

Incorporated in the valve actuator mechanism is an elongated actuator member 30 pivotally mounted relative to the cabinet. The actuator member is alternatively selectively engageable by the pivotally mounted manually operable push lever and the rotating member 20 to pivot the actuator member and cause operation of the dispensing valve structure and dispensing of liquid from the container by the dispensing valve structure. A suitable interconnection exists between the actuator member and the dispensing valve structure.

Figure 7:
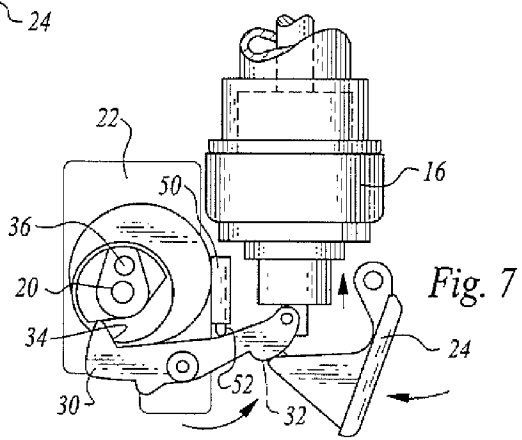
FIG. 7 is a view similar to FIG. 2, but illustrating the dispensing valve structure being operated by a manually operable member rather than by electrical motor.

The actuator member 30 has a first cam surface 32 engageable by the pivotally mounted push lever as shown in FIG. 7, pressure applied to the actuator member by the pivotally mounted push lever pivoting the actuator member and causing the dispensing valve structure 16 to operate.

Figure 6:
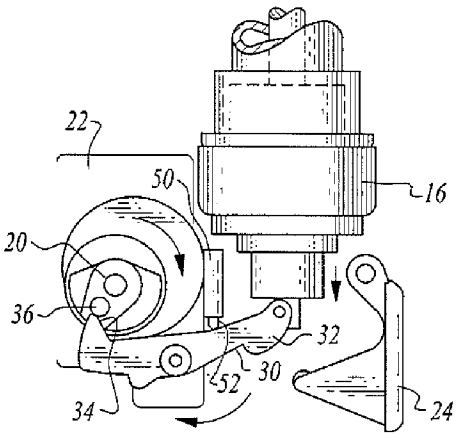
FIG. 6 is a view similar to FIG. 3, but illustrating the condition of the illustrated structure just after operation of the dispensing valve structure has been caused by the motor.
Figure 5:
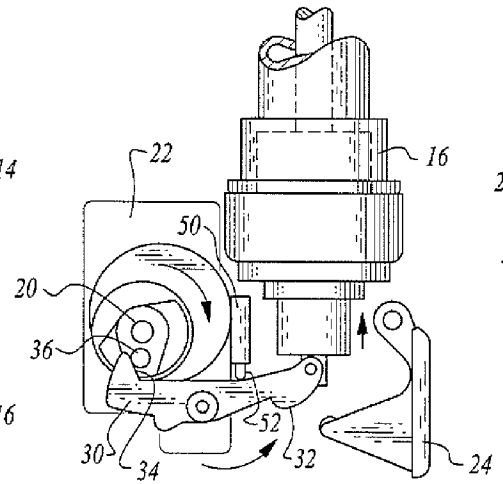
FIG. 5 is a view similar to FIG. 4, but illustrating commencement of the dispensing of liquid soap by the valve actuator mechanism operated by an electric motor.
Figure 4:
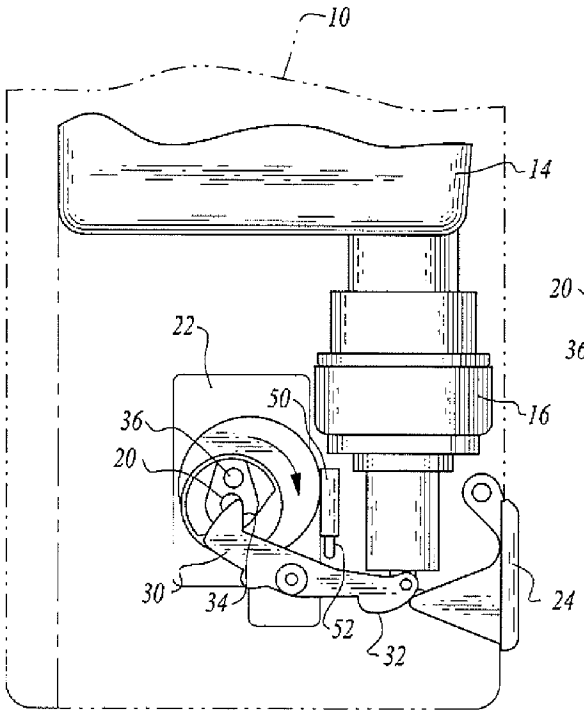
FIG. 4 is a side, elevational view illustrating a container portion and connected dispensing valve structure in operative association with valve actuator mechanism and other structural components of the dispenser apparatus prior to operation of the dispensing valve structure to dispense liquid soap from the container.

The actuator member 30 has a second cam surface 34 spaced from the first cam surface engageable by the rotating member 20 upon energization of electric motor 22. The actuator member is responsive to pressure applied thereto by the rotating member 20 at the second cam surface 34 to pivot the actuator member and operate the dispensing valve structure. FIGS. 4 and 5 illustrate this action. The rotating member 20 has a projection 36 slidably engageable with the second cam surface during rotation of the rotating member. FIG. 4 shows the position of the projection 36 during start of rotation of the rotating member 20 by motor 22. FIG. 5 shows the projection 36 engaging cam surface 34 to pivot the actuator member. And FIG. 6 illustrates the position of the projection 36 just prior to being disengaged from the second cam surface during continued rotation of the rotating member by motor 22. The rotating member 20 will cease rotation when the projection again reaches the position shown in FIG. 4 through utilization of any suitable switch or other control associated with the motor.

The hybrid operation of the dispenser has a number of advantages. There is less reliance on batteries, and lessening of problems concerning infrared and related soap system maintenance issues. The hybrid function ensures that patrons always have soap, resulting in less complaints and related frustration taken out on dispensers (vandalism). For the end user, when soap is in the container, there will always be access to soap whether during electrical powered (auto) operation or manual operation.

The dispensing apparatus includes indicators, such as indicators generally designated by reference numeral 40, to advise of certain conditions such as the apparatus being in condition for non-manual operation by the electric motor. Replacement of batteries or other suitable action may be carried out by maintenance personnel in a timely manner.

Another important aspect of the dispensing apparatus is the inclusion of counter means for counting the total number of times liquid is dispensed from the container due to operation by the valve actuator mechanism by either the electric motor or the manually operable member. Suitable indicators such as indicator 42 may be utilized to provide an indication of the count.

Counter structure 50 including a switch is employed that counts uses regardless of whether the system operates in manual or automatic (electrical) mode to ensure the count of a refill is accurately reflected. In the arrangement shown, the downwardly extending switch element 52 of the counter structure 50 switch retracts to close the switch when engaged by upwardly moving actuator member 30. The counter structure could be located at other locations and be of any suitable type.

The system can be used with an assortment of pumps/valves (refills). A switch may be employed in the dispensing apparatus that will recognize new refills automatically.

The power source (batteries) will be managed and possibly a small energy device (hearing aid battery and/or power harvesting CPU) may be added to a PCB that will allow the system to provide indicators (low refill, battery dead indicator) and count refill after the core set of batteries (alkalines) are no longer able to pump the refill).

The invention claimed is:

1. Dispenser apparatus for dispensing liquid soap, lotion or other liquid, said dispenser apparatus including, in combination:

a cabinet defining an interior for holding a container containing liquid and dispensing valve structure connected to said container to dispense liquid from said container;

valve actuator mechanism connected to said cabinet for operating said dispensing valve structure to dispense liquid from the container when said container and dispensing valve structure are held within said interior;

an electric motor; and a manually operable member movably mounted relative to said cabinet and accessible from a location external of said cabinet, said electric motor and said manually operable member selectively alternatively cooperable with said valve actuator mechanism to cause said valve actuator mechanism to operate said dispensing valve structure and dispense liquid from said container, said valve actuator mechanism including a rotating member rotatable by said electric motor when said electric motor is energized and a double-ended actuator member mounted for pivotal movement relative to said cabinet about a pivot axis located between the ends thereof, said actuator member alternatively selectively engageable by said manually operable member and by said rotating member to pivot said actuator member about said pivot axis and cause operation of said dispensing valve structure and dispensing of liquid from said container by said dispensing valve structure, said actuator member including a top and a bottom, said bottom having first cam surface spaced from said pivot axis and located at one side of said pivot axis engageable by said manually operable member, and said actuator member responsive to pressure applied thereto by said manually operable member at said first cam surface to pivot and operate said dispensing valve structure, and the top of said actuator member having a second cam surface spaced from said pivot axis and located at the other side of said pivot axis engageable by said rotating member and responsive to pressure applied to said actuator member by said rotating member at said second cam surface to pivot said actuator member and operate said dispensing valve structure, said rotating member slidably engageable with said second cam surface during rotation of said rotating member, said actuator member being operatively connected to said dispensing valve structure adjacent to said first cam surface, and said second cam surface and said rotating member disengaged when said manually operable member applies pressure to said actuator member at said first cam surface.

2. The dispensing apparatus according to claim 1 wherein said rotating member includes a projection slidably engageable with said second cam surface during rotation of said rotating member.

3. The dispensing apparatus according to claim 1 additionally including visual indicators for indicating when said dispensing apparatus is in condition for non-manual operation by said electric motor.

4. The dispensing apparatus according to claim 1 additionally including counter means for counting the total number of times liquid is dispensed from said container due to operation of said actuator member by either said electric motor or said manually operable member.

5. The dispensing apparatus according to claim 1 additionally including lock-out structure allowing only specific container and dispensing valve structure combinations to be utilized.

6. The dispensing apparatus according to claim 4 wherein the counter means includes a switch operatively associated with said actuator member.

7. The dispensing apparatus according to claim 6 wherein said switch includes a switch element engageable with said actuator member.

* * * * *